US007950873B2

(12) United States Patent
Geiger

(10) Patent No.: US 7,950,873 B2
(45) Date of Patent: May 31, 2011

(54) SET OF PAVING BLOCKS

(76) Inventor: Peter Geiger, Neumarkt (DE)

( * ) Notice: Subject to any disclaimer, the term of this patent is extended or adjusted under 35 U.S.C. 154(b) by 114 days.

(21) Appl. No.: 11/921,916

(22) PCT Filed: Jun. 14, 2006

(86) PCT No.: PCT/DE2006/001028
§ 371 (c)(1),
(2), (4) Date: Mar. 20, 2009

(87) PCT Pub. No.: WO2006/133688
PCT Pub. Date: Dec. 21, 2006

(65) Prior Publication Data

US 2009/0202297 A1 Aug. 13, 2009

(30) Foreign Application Priority Data

Jun. 16, 2005 (EP) ..... 05012991

(51) Int. Cl.
*E01C 5/00* (2006.01)
*E04B 5/04* (2006.01)
*E04C 2/04* (2006.01)

(52) U.S. Cl. ..... 404/39; 404/17; 404/34; 404/37; 404/38; 404/42; 52/603; 52/604; 52/605

(58) Field of Classification Search ..... 404/34, 404/37, 38, 39, 41; 52/604; D25/113
See application file for complete search history.

(56) References Cited

U.S. PATENT DOCUMENTS 132,620 A * 10/1872 Bassett ..... 404/37
4,496,266 A * 1/1985 Ruckstuhl ..... 404/41
4,792,257 A * 12/1988 Rinninger ..... 404/41
4,907,909 A * 3/1990 Ruckstuhl ..... 404/37
5,028,167 A * 7/1991 Scheiwiller ..... 404/41
5,054,957 A * 10/1991 Johnson, II ..... 404/41
5,163,777 A * 11/1992 Krueger et al. ..... 404/41
5,249,884 A * 10/1993 Widmer ..... 404/42
5,251,997 A * 10/1993 Brock ..... 404/29
5,466,089 A * 11/1995 Jurik ..... 404/34

(Continued)

FOREIGN PATENT DOCUMENTS

| | | |
|---|---|---|
| DE | 200 20 366 | 4/2001 |
| DE | 201 15 963 | 12/2001 |
| DE | 103 36 484 | 3/2005 |
| EP | 0 622 493 | 11/1994 |
| WO | WO 99/54552 | 10/1999 |

OTHER PUBLICATIONS

International Search Report.

(Continued)

*Primary Examiner* — Gary S Hartmann
(74) *Attorney, Agent, or Firm* — Collard & Roe, P.C.

(57) ABSTRACT

A set of concrete pavers is formed by a plurality of pavers being arranged in a paver row, and a plurality of paver rows being arranged to form a row. A number of parallel, adjacent rows form linear or meandering joints in the end-paver region of the rows when the rows are laid together. At least one section of the upper delimiting surface of the pavers is convexly cambered towards the outside, and projections on the side faces of the pavers form support elements for the adjacent pavers. The support elements, in combination with projections on adjacent pavers, create spaces that act as water-drainage openings in the joint regions. The pavers in each set include not only paving blocks with a length-to-height ratio of less than or equal to 4 but also at least one paving slab with a length-to-height ratio greater than 4.

9 Claims, 8 Drawing Sheets

U.S. PATENT DOCUMENTS

| | | | | |
|---|---|---|---|---|
| 5,560,173 | A * | 10/1996 | Scheiwiller | 52/608 |
| 6,168,347 | B1 * | 1/2001 | Milot et al. | 404/34 |
| 6,536,988 | B2 * | 3/2003 | Geiger | 404/39 |
| 7,108,448 | B2 * | 9/2006 | Hagenah | 404/41 |
| 7,632,036 | B2 * | 12/2009 | Dupuis | 404/34 |
| 2001/0048849 | A1 * | 12/2001 | Rinninger | 404/41 |

OTHER PUBLICATIONS

English translation of International Preliminary Report on Patentability (IPRP) and Written Opinion of the International Searching Authority.

* cited by examiner

SET OF PAVING BLOCKS

CROSS REFERENCE TO RELATED APPLICATIONS

This application is the National Stage of PCT/DE2006/001028 filed on Jun. 14, 2006 which claims priority under 35 U.S.C. §119 of European Application No. 05012991.5 filed on Jun. 16, 2005. The international application under PCT article 21(2) was not published in English.

BACKGROUND OF THE INVENTION

The invention relates to a set of concrete pavers.

Field of the Invention

The object of the invention is to provide a set of pavers, which is designed to be particularly varied. This object is achieved by a set according to the invention. Advantageous embodiments are described below.

SUMMARY OF THE INVENTION

The set of concrete pavers according to the invention consists, inter alia, of pavers which form rectangular or square machine-graspable laying bundles, which are particularly easily combinable and, if need be, can be laid by mechanical means and in a cost-effective manner.

The set according to the invention possesses both paving blocks as pavers and slabs as pavers. According to standard EN 1339:2003 (D) point 3.2, a concrete slab is described as a prefabricated concrete product, the total length of which divided by its thickness (height) is greater than the number 4. In contrast thereto, by "paving block" is meant, according to this standard, pavers which are configured with considerably smaller area relative to their height and, in particular, have a length-to-height ratio less than or equal to the number 4.

In an advantageous embodiment, the set comprises paving blocks having a length-to-height ratio less than the number 3 and slabs as pavers having a length-to-height ratio greater than the number 5.

All in all, especially in connection with the advantageous embodiment, a particularly varied set is obtained through the combination of relatively large-area slabs with relatively small-area paving blocks.

According to an advantageous embodiment, the paving blocks and slabs are mutually coordinated in size such that at least one joint next to a slab merges into a joint next to an adjacent paving block.

The set thus possesses joints which extend continuously next to paving blocks and adjacent slabs. As a result, laying bundles which are formed can be grasped particularly easily by mechanical means and a modular combination of different laying bundles can be realized without protrusion of cornerstones and thus without subsequent machining.

According to a further advantageous embodiment, the paving blocks and slabs are mutually coordinated in size such that at least one joint next to a paving block ends at the edge of an adjacent slab.

Hence, on the one hand, a visually varied overall impression is achieved, whilst on the other hand the joint, which is used as a water discharge opening, serves by virtue of its T-shaped configuration as a directional water conduit, which channels impinging rainwater and melt water and carries it away directed from the paving blocks to the adjacent slab edge. Drainage water is thus prevented from passing onto the surface of the slabs, which, due to film formation or icing, would present a risk of sliding for persons or vehicles.

According to a further advantageous embodiment, the paving blocks and slabs are mutually coordinated in size such that the set has at least one continuous joint next to paving blocks and adjacent slabs.

Water which arises and has to be removed can hence be carried away via a considerable longitudinal guide parallel to adjacent paving blocks and slabs. The drainage water is thus prevented from striking the surface of the slabs or paving blocks and from thereby possibly impairing the road safety of using persons and vehicles.

According to a further advantageous embodiment, the paving blocks and slabs possess projections, which form support elements between adjacent paving blocks and slabs. A mutual supporting of paving blocks and slabs is thereby achieved, even where paving blocks and adjacent slabs impinge directly one upon the other.

The slabs, due to their rather large-area construction, here ideally serve to support a plurality of adjacent, contiguous paving blocks. The laying constancy and positional stability of the laid set is thereby ensured even under heavy load and when forces are transmitted to the paving blocks and slabs by the users and vehicles.

According to a further advantageous embodiment, the projections of the paving blocks possess a greater thickness and the projections of the slabs a lesser thickness. This has the effect that the joint spacing between a slab and an adjacent paving block turns out to be somewhat larger than the joint spacing between adjacent slabs. As a result of the enlarged joint between paving block and slab, where efforts are made to prevent drainage water from passing onto the slab, an improved water discharge can be achieved.

According to a further embodiment, individual or a plurality of paving blocks possess projections, in which each projection forms a support element for a corresponding projection of an adjacent paving block or an adjacent slab.

A paving block which is configured in this way is supported with its projections, over the whole of its lateral peripheral surface, by corresponding projections of the adjacent paving blocks and slabs and can thus be positioned in a particularly positionally stable manner when forces are transmitted to the paving block.

According to a further embodiment, the edges of adjacent paving blocks and slabs possess different heights. Particularly in the case of edges which slope down relative to the middle regions of the paving blocks and slabs (whether through cambering or through a bevel), a purposeful water removal is realized in the region of the edges of the paving blocks and slabs.

The design of paving blocks and slabs with edges of different height allows a water drainage to be channeled within the set. If paving blocks are configured with edges of lesser height, for instance, a type of "trough character" of the paving blocks can be produced relative to the adjacent slabs.

The paving blocks here form a somewhat depressed trough and carry off arising water, for example where an inclination and sloping are present. The paving blocks within the set thus acquire a depressed trough character and thereupon lend the set the characteristics of a directed water drainage.

Through purposeful configuration of the heights of the edges of the paving blocks and adjacent slabs, it is possible to establish whether the plane of the paving blocks is to be made depressed relative to the plane of the slabs, or the plane of the slabs is to be made depressed relative to the plane of the paving blocks. Troughs can hence be purposefully produced in the region of the paving blocks or slabs and the water run-off can thereby be channeled and directed, particularly given a slight inclination of the paving surface.

The invention is further explained with reference to an illustrative embodiment in the drawing figures, wherein

BRIEF DESCRIPTION OF THE DRAWINGS

FIG. 1 shows a first embodiment of a set of slabs P1 and P2, having the exemplary dimensions 38 cm×19 cm and 38 cm×57 cm, and numbered paving blocks 1-12 and 21-33.

DETAILED DESCRIPTION OF PREFERRED EMBODIMENTS

Figure 1:
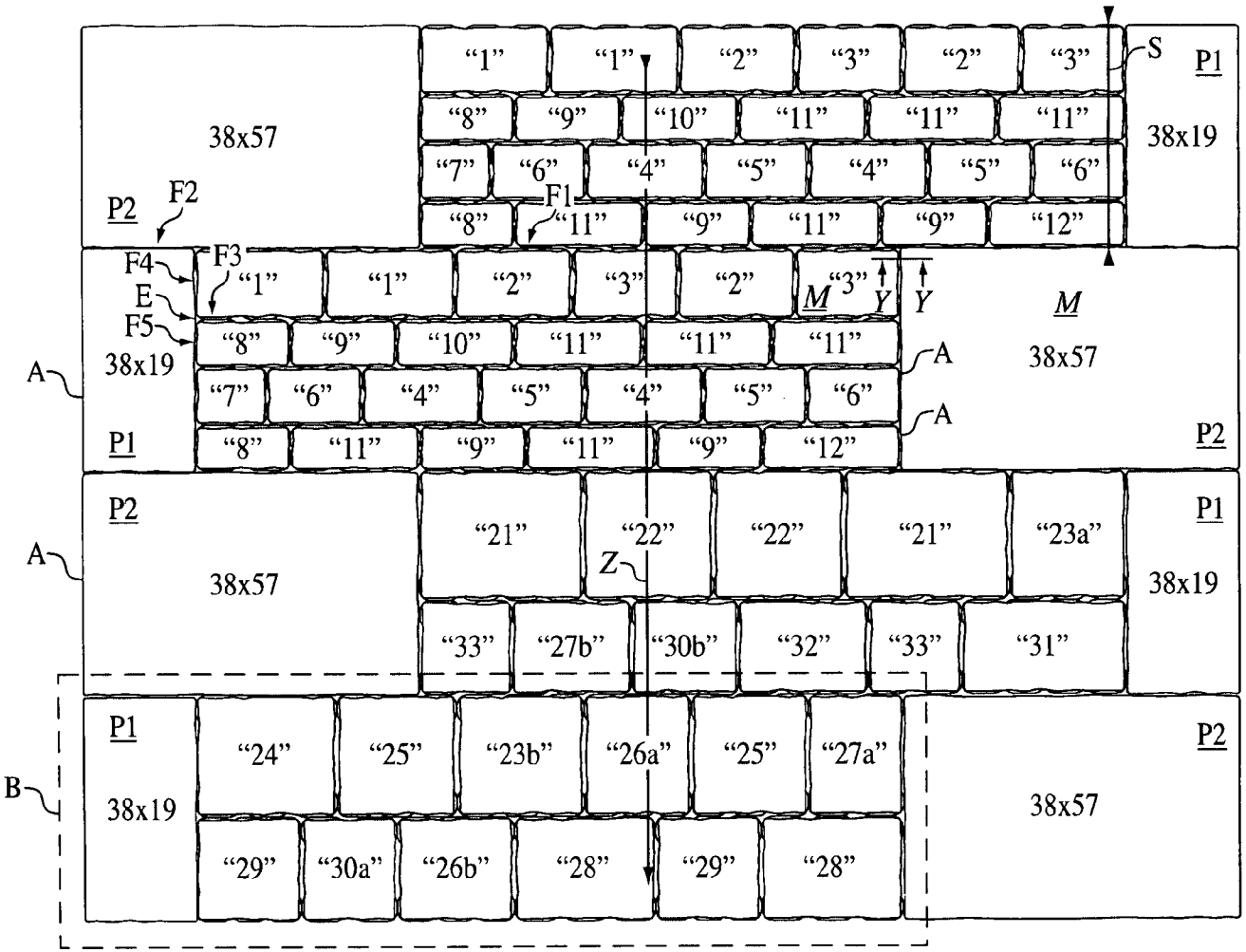
FIG. 1 shows a set in a first embodiment.

The paving blocks 1-12 and 21-33 are here respectively disposed adjacent to the slabs P1 and P2. All in all, a total set according to FIG. 1 is obtained, which can be grasped and laid by mechanical means. The set can thus comprise the whole of the paving blocks and slabs represented in FIG. 1. In addition, smaller rectangular sets, for example the smaller set B comprising a slab P1 and the paving blocks 24, 25, 23*b*, 26*a*, 25, 27*a*, 29, 30*a*, 26*b*, 28, 29, and again 28, can also be assembled within the frame.

The slabs P and paving blocks possess (partially labelled) projections A (cf. also FIG. 3), which form support elements for adjacent projections A of adjacent paving blocks or slabs. The projections of the slabs P here possess, in particular, a lesser thickness than the projections of the paving blocks, for instance the thickness T20 of the projection A20 measures, in particular, less than half the thickness T30 of the projection 30. This means that joints with projections A20 (i.e. between adjacent slabs P) are narrower than joints with projections A30 (i.e. between adjacent paving blocks). Drainage water can thereby be prevented from making its way between slabs P, since it trickles away beforehand in the wider joints between the paving blocks (cf. FIG. 3). The set according to the invention thus allows the purposeful control of the water discharge behavior by concentration on the areal region comprising paving blocks.

FIG. 1 shows a total set in which the paving blocks 1-12 arranged in four rows between the slabs P1 and P2 are precisely coordinated in size with the slabs P1 and P2 and, in the present case, an identical total width of 38 cm (from the outer side of a projection of paving block 3 to the outer side of a projection of paving block 12 according to the segment S). Thus, the cumulative width of the paving blocks 3, 11, 6 and 12 with the joint widths between the paving blocks 3 and 11, 11 and 6 and 6 and 12 also produces the exemplary measure 38 cm, i.e. a length of the slab P1 (likewise from outer side of projection to outer side of opposite projection).

There are thus obtained, on the one hand, joints F1 between adjacent paving blocks, which merge into joints F2 between adjacent slabs P1 and P2. In addition, joints F3 are present, which are disposed between adjacent rows of paving blocks and end at end points E on adjacent slabs. T-shaped water drainage joints W are formed, which allow water to drain from the joint F3 into joints F4 and F5 disposed at right angles thereto and thus do not allow water carried off in the joint F3 to pass onto the surface, for example, of the slab P1.

The paving block rows comprising the paving blocks 21, 22, 22, 21 and 23*a*, as well as 33, 27*b*, 30*b*, 32, 33 and 31, are also mutually coordinated in size with the adjacent slabs P1 and P2 and likewise possess the exemplary total width 38 cm.

Figure 2:
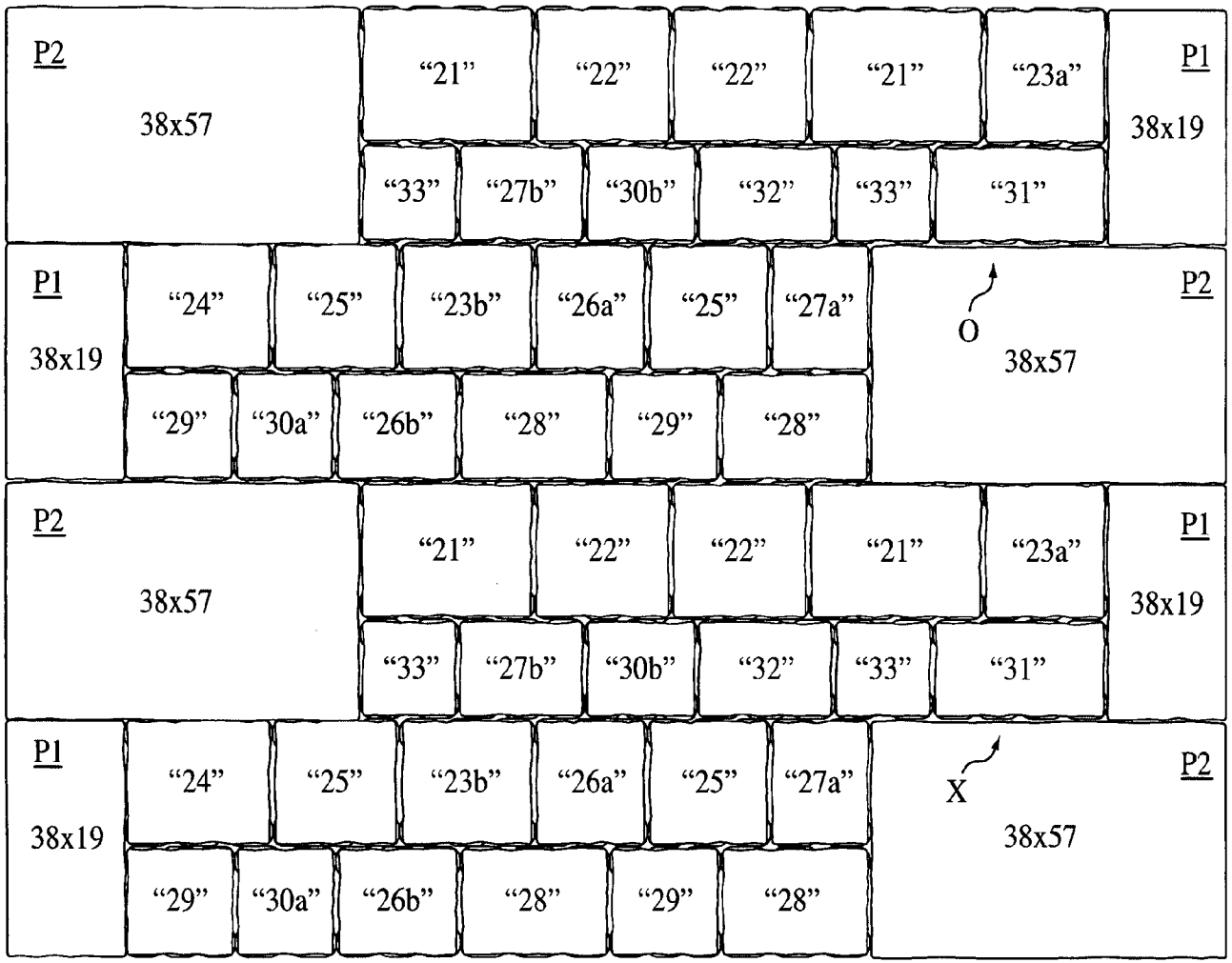
FIG. 2 shows a set in a further embodiment.

FIG. 2 shows a further embodiment of a set. The slabs P1 and P2 having the exemplary size 38 cm×57 cm and 38 cm×19 cm, and therebetween respectively two rows of paving blocks 21-31 and 24-28, are here likewise accommodated.

The adjacent arrangement of alternately different slabs P1 and P2 produces a particularly varied overall impression. In addition, adjacent paving blocks, by virtue of corresponding and mutually supporting projections, are accommodated in a particularly secure manner.

Figure 3:
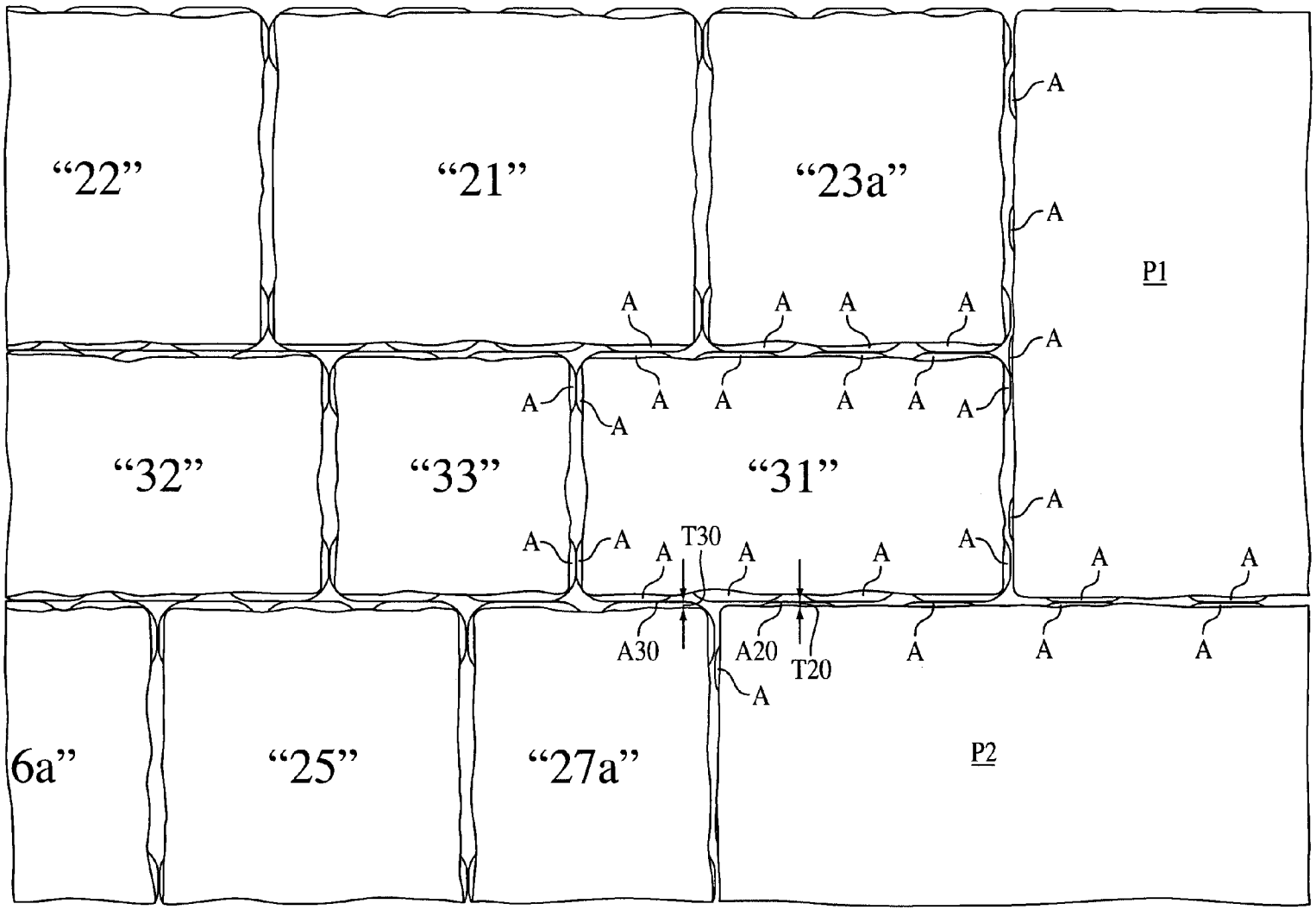
FIG. 3 shows an enlarged representation O from FIG. 2.
Figure 4:
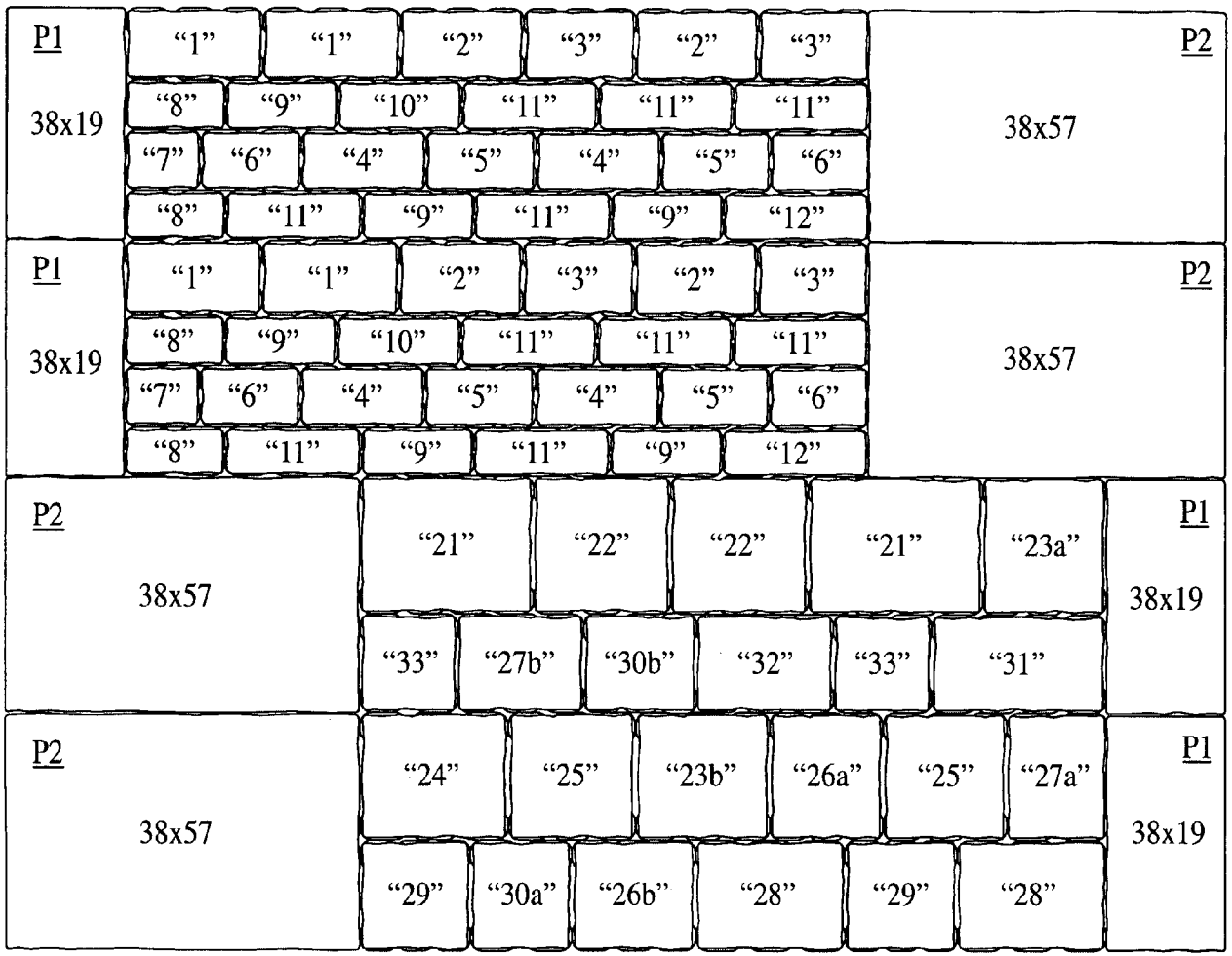
FIG. 4 shows a set in a further embodiment.
Figure 5:
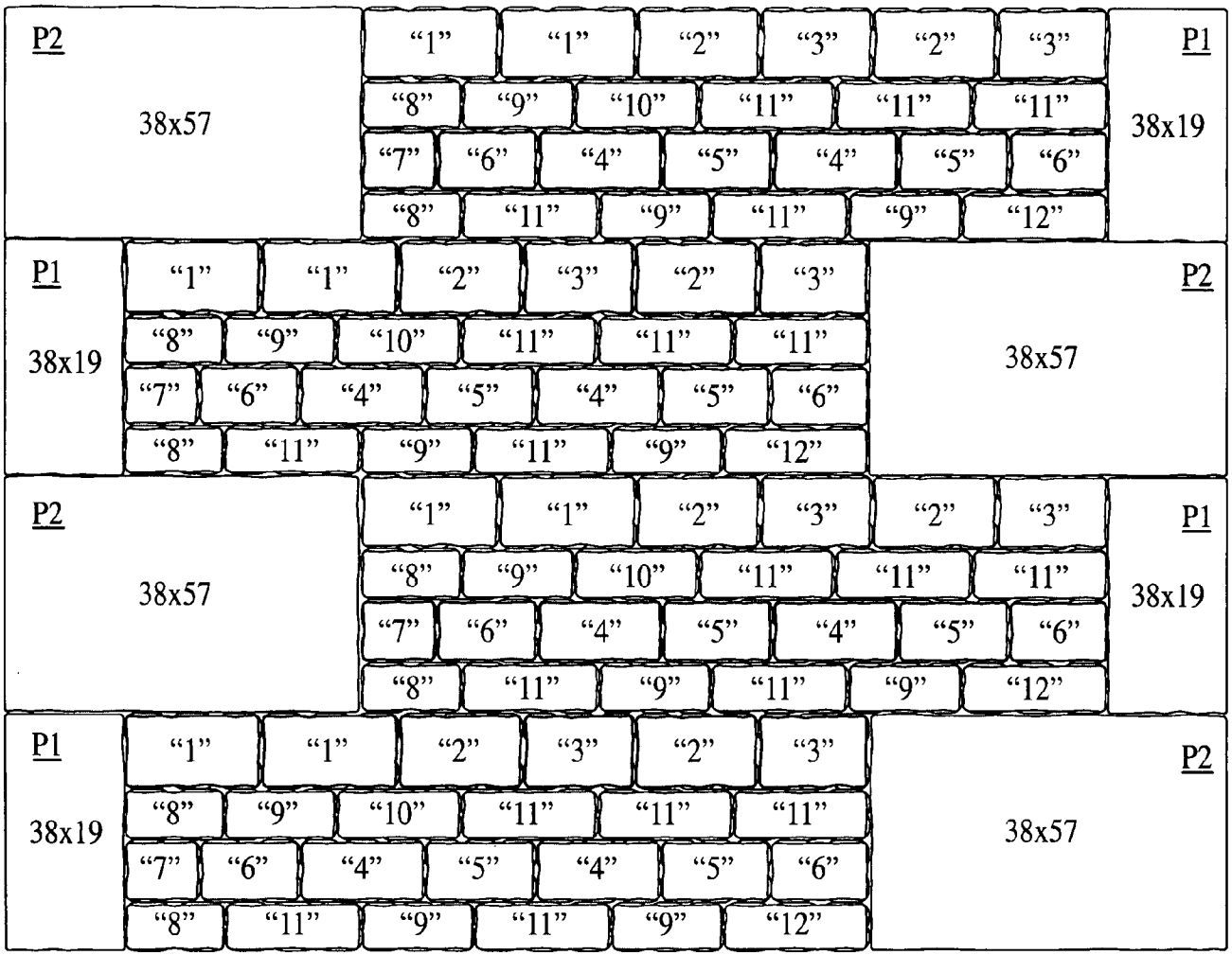
FIG. 5 shows a set in a further embodiment.
Figure 6:
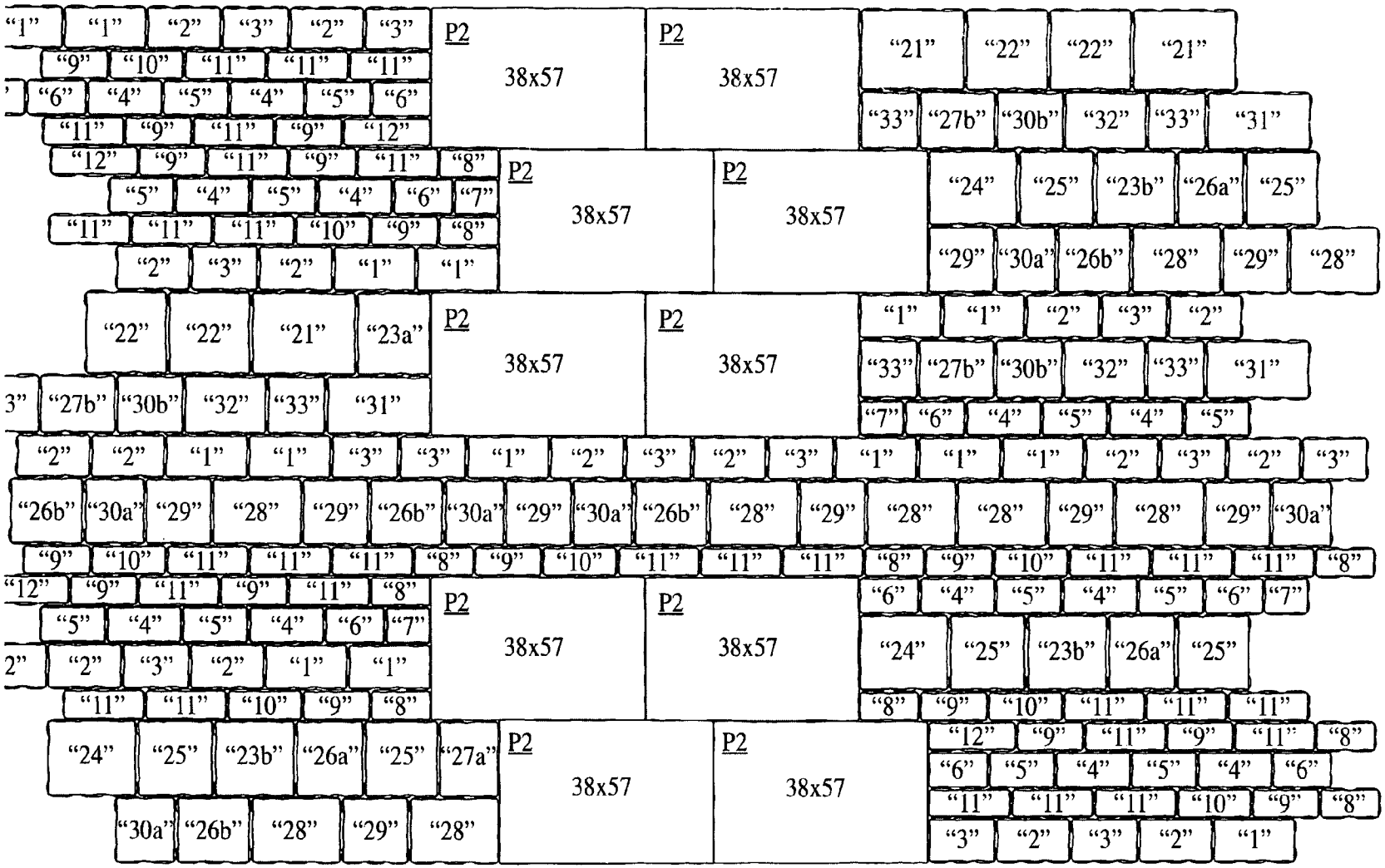
FIG. 6 shows a set in a further embodiment.
Figure 7:
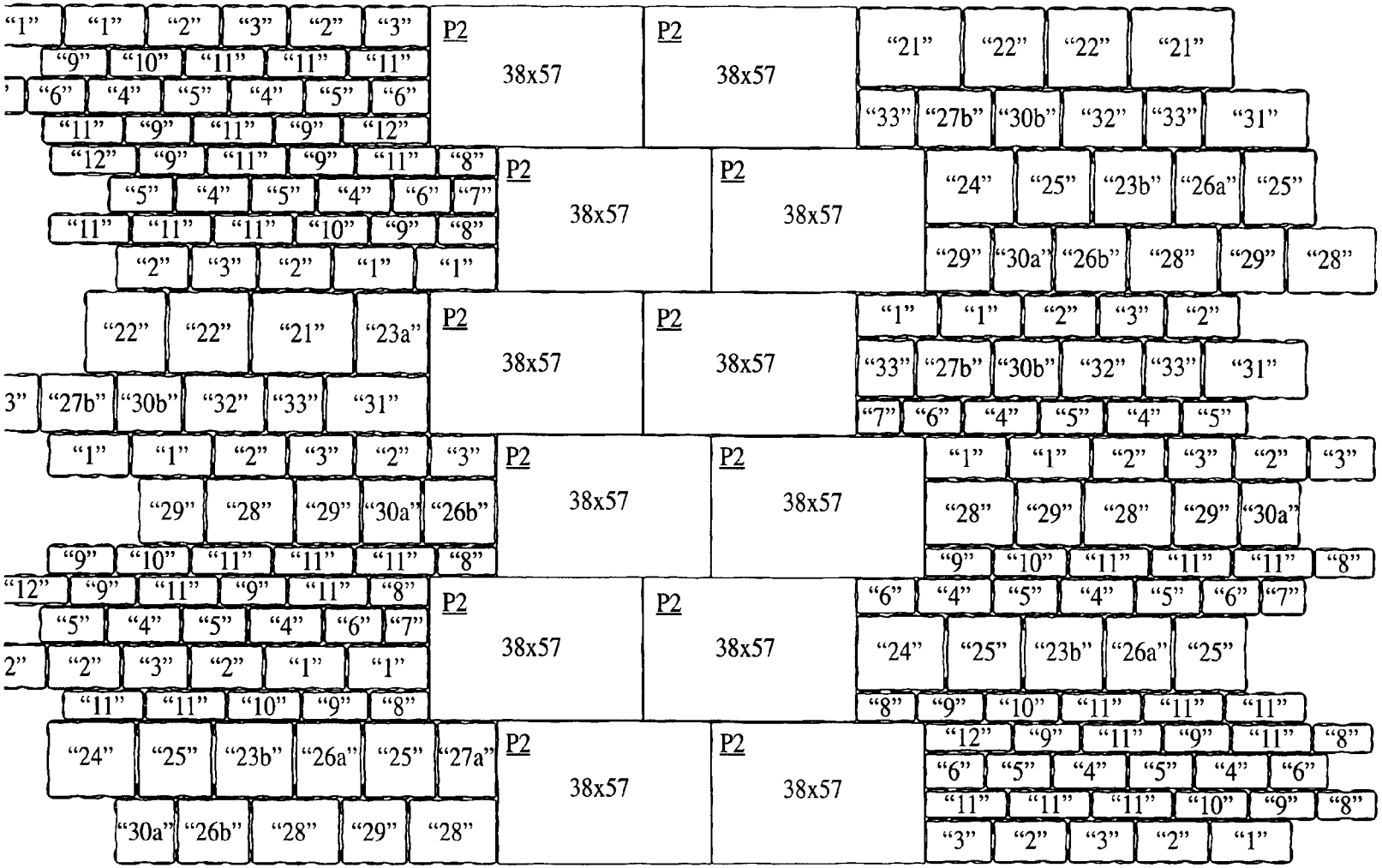
FIG. 7 shows a set in a further embodiment.

FIG. 3 shows an enlarged representation from FIG. 2 from the region X. The paving block 31 is here accommodated in a particularly secure manner by labelled spacers A of the slab P2, spacers A of the slab P1 and the spacers of the surrounding adjacent paving blocks 23*a*, 21, 33 and 27*a*, corresponding projections of the surrounding paving blocks and slabs to each of the own projections A being present and serving as support elements.

As a result, the paving block 31 is accommodated in a particularly secure and positionally fixed manner and can be held particularly stationary under transmitted force loads.

FIGS. 4 to 7 show a further embodiment of a set of further paving blocks and slabs P which are mutually coordinated in size. Thus, in FIG. 6, the total width of the rows of paving blocks arranged between the stair-staggered slabs P2, for example with the paving blocks 3, 26*b* and 11 arranged one above the other, corresponds to the exemplary width 38 cm of the slab P2.

Figure 8:
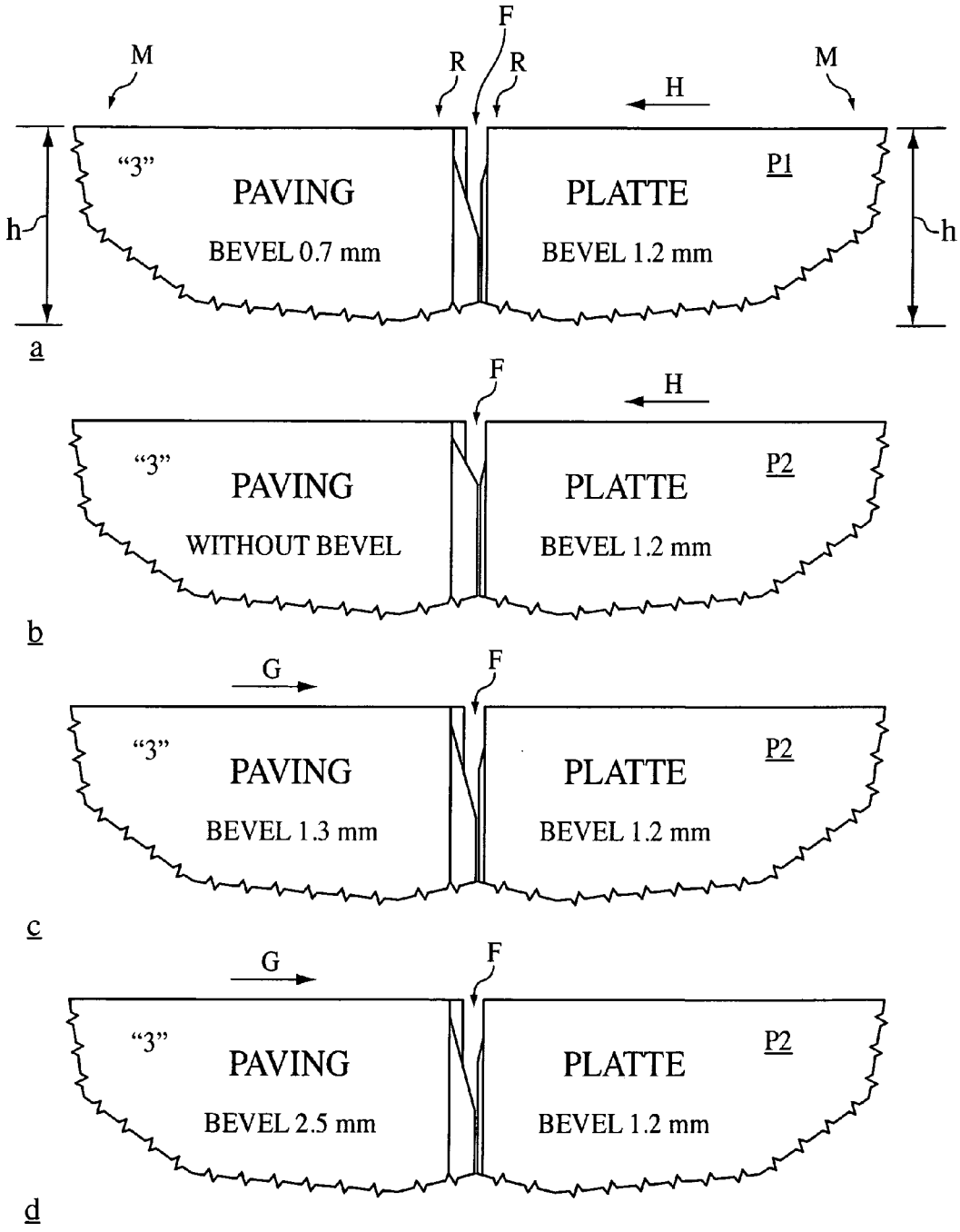
FIG. 8 shows a section Y-Y according to FIG. 1 through a paving block and an adjacent slab with different configurations of the transition regions between paving block and slab according to a-d.

FIG. 8 shows a sectional representation Y-Y from FIG. 1. The paving block 3, which is used by way of example, and the slab P2 possess in their middle regions M identical heights h of, for example, 8 cm or 10 cm. At the edges R the paving blocks and slabs are configured, where appropriate, with lesser height, i.e. less than, for example, 8 cm or 10 cm, to be precise through a sloping camber and/or a bevel, in the transition from the lower outer edge height to the higher middle region M of the paving block or slab, in particular, no edge and no side edge, but rather a fluid, rounded transition, being formed.

In the representation a according to FIG. 8, the paving block 3 possesses a bevel (i.e. a height reduction relative to the region M) of 0.7 mm and the slab P a bevel of 1.2 mm. Thus the paving block 3, at its edge, is configured somewhat higher than the slab P2.

In the embodiment according to b, the paving block 3 possesses no bevel at all, i.e. no edge slope at all, and the slab P1 possesses an edge slope of 1.2 mm. In addition, the slab P1 can also have no edge slope (not depicted).

In the representation c, the paving possesses an edge slope of 1.3 mm and the slab possesses an edge slope of 1.2 mm. In the representation d, the paving possesses an edge slope of 2.5 mm and the slab possesses an edge slope of 1.2 mm.

In the embodiments a and b, the edge region of the paving block 3 is thus configured such that it is elevated relative to the edge region of the slab P2. In the representations c and d, the edge region of the paving block 3 is configured with lesser height than the edge region of the slab P2.

In the representations c and d, drainage water which arises and is fed in the direction G, can thus be stopped by the respectively elevated edge of the slab P2 and can trickle away in the joint F.

In the representations a and b, water fed in the direction H is likewise fed to the joint F, thereby preventing passage to the surface of the paving block 3.

In general, the invention, through the configuration of higher and different edges of adjacent pavings and slabs, thus allows arising water streams to be fed purposefully to specific joints. Arising water streams can thus be prevented from encroaching onto surfaces of pavings and slabs.

Thus, in the embodiment according to FIG. 1, the depressed and shortened configuration of the edges of the paving blocks relative to the respectively adjacent edges of the slabs produces a trough character of the paving blocks relative to the slabs, whereby water can be discharged in the arrow direction Z according to FIG. 1 and prevented from passing onto the surfaces of the adjacent and surrounding slabs P.

Alternatively, the edges of the slabs P1 and P2 in the embodiment according to FIG. 1 can be of depressed configuration, so that then, with respect to adjacent slabs P1 and P2, a trough character relative to the adjacent paving surfaces is formed and the water discharge takes place on the water slabs P (not depicted).

According to a further advantageous embodiment, the edges of adjacent slabs P1 and P2 or of adjacent paving blocks, for example of the paving blocks 1, 2 and 3 according to FIG. 1, have edges of different heights.

The grip of the surface is thereby increased and increased grip can be achieved during use by persons or by vehicles.

In this context, a further object of the invention can be to achieve a specific directed water drainage behavior and a purposeful improvement in negotiability and grip through the design of the dimensions of the paving blocks and slabs, in particular of the height of the edges.

REFERENCE SYMBOLS

1-12 paving block
21-33 paving block
A projection
B set
E end point
F joint
G direction
H direction
h height
p slab
R edge
M middle
Z direction
S segment
T thickness

The invention claimed is:

1. A set comprising a plurality of pavers, each paver of the plurality of pavers being substantially rectangular, having an upper delimiting surface, having vertical side faces, and having a plurality of projections disposed spaced apart on the vertical side faces, the plurality of projections forming support elements for adjacent pavers of the plurality of pavers and creating a respective interspace between the respective paver and the adjacent pavers, wherein at least a part-region of the upper delimiting surface cambers outwards, and wherein the plurality of pavers is arranged in at least first and second rows of pavers, the first row of pavers being arranged side-by-side and parallel to the second row of pavers;

wherein each of the first row of pavers and the second row of pavers comprises:

respective first, second, third, and fourth paving block rows arranged side by side in parallel, each of the first, second, third, and fourth paving block rows comprising a respective plurality of paving blocks of the plurality of pavers, the paving blocks of each of the first, second, third, and fourth paving block rows being adjacent side-by-side, respectively, and each paving block of each plurality of paving blocks having a length-to-height ratio less than or equal to four; and respective first and second slabs of the plurality of pavers, the respective first and second slabs being adjacent to paving blocks of each of the first, second, third, and fourth paving block rows, and each of the respective first and second slabs, respectively, having a length-to-height ratio greater than four;

wherein the first and second rows of pavers form in respective first and second adjoining regions of the first and second slabs, respectively, and the plurality of paving blocks a first joint and a second joint, respectively, selected from the group consisting of a linearly-continuous joint and a substantially-meandering joint; and wherein a respective cumulative width of the respective first, second, third, and fourth rows of each of the first rows of pavers and the second rows of pavers is equal to a width of each of the respective first slab and the respective second slab.

2. The set as claimed in claim 1, wherein the paving blocks and slabs are mutually coordinated in size such that at least one joint next to a slab merges into at least one joint next to an adjacent paving block.

3. The set as claimed in claim 1, wherein the paving blocks and slabs are mutually coordinated in size such that at least one joint next to a paving block ends at an edge of an adjacent slab.

4. The set as claimed in claim 1, wherein the paving blocks and slabs are mutually coordinated in size to form at least one continuous joint next to the paving blocks and slabs.

5. The set as claimed in claim 1, wherein the projections of the paving blocks are configured with greater thickness and the projections of the slabs are configured with lesser thickness.

6. The set as claimed in claim 1, wherein each projection of each paving block forms a support element for a corresponding projection of an adjacent paving block or of an adjacent slab.

7. The set as claimed in claim 1, wherein the paving blocks and adjacent slabs have edges of different heights.

8. The set as claimed in claim 7, wherein each edge of a paving block is higher than the edge of an adjacent slab.

9. The set as claimed in claim 7, wherein the edges of adjacent paving blocks have different heights.

* * * * *